US005199360A

United States Patent [19]

Koistinen

[11] Patent Number: 5,199,360

[45] Date of Patent: Apr. 6, 1993

[54] TABLE CONSTRUCTIONS

[76] Inventor: Sirkka Koistinen, Tuollavaaravägen 6B, 981 41 Kiruna Sverige, Sweden

[21] Appl. No.: 669,400

[22] PCT Filed: Sep. 26, 1988

[86] PCT No.: PCT/SE89/00518

§ 371 Date: Mar. 21, 1991

§ 102(e) Date: Mar. 21, 1991

[87] PCT Pub. No.: WO90/03133

PCT Pub. Date: Apr. 5, 1990

[30] Foreign Application Priority Data

Sep. 27, 1988 [SE] Sweden ..... 8803424
Dec. 14, 1988 [SE] Sweden ..... 8804525

[51] Int. Cl.[5] ..... A47F 5/12

[52] U.S. Cl. ..... 108/3; 108/1; 108/6

[58] Field of Search ..... 108/3, 6, 7, 9, 1, 2; 108/145; 248/456, 101, 371, 188.1

[56] References Cited

U.S. PATENT DOCUMENTS 8,486 11/1851 Hammitt ..... 108/3
133,087 11/1872 Dummer ..... 108/1
173,706 2/1876 Woolson ..... 108/6
2,623,435 12/1952 Geis ..... 108/3
2,843,226 7/1958 Nordmark ..... 108/6 X

FOREIGN PATENT DOCUMENTS 0017222 4/1980 European Pat. Off. .
345194 5/1972 Sweden .
2901 5/1990 Sweden .
166447 1/1934 Switzerland ..... 108/3
257751 4/1949 Switzerland ..... 108/6

*Primary Examiner*—Jose V. Chen
*Attorney, Agent, or Firm*—Finnegan, Henderson, Farabow, Garrett & Dunner

[57] ABSTRACT

A table construction which makes possible work in a sitting position as well as in a standing position comprises two table tops (4,7) hingedly connected to each other and together with a link (10) and a part of a base frame (1) forming a parallel arm structure with one of the table tops (7) substantially horizontal irrespective of the angular position of the second table top. Pivotally connected to the link (10) is a catch arm (13) which cooperates with a catch (14) provided at the base frame. A resilient support arm (16) counteracts the folding up of the link when the latter approaches its uppermost position and maintains the catch arm in a safe engagement with the catch.

9 Claims, 2 Drawing Sheets

TABLE CONSTRUCTIONS

The present invention refers to an improvement in table constructions.

Recently table constructions have been suggested in which one or several table tops are so connected to a table stand that they can be inclined to form desk-like units or sections. This depends upon the knowledge about the reaction of the human body to different positions of work.

However, these known table constructions have only partly been able to fulfill the requirements which such knowledge raises upon work tables.

For instance it has not been possible without complicated, heavy and expensive constructions to produce work tables which are suited for work in a sitting as well as a standing position. The stability has in most cases been unsatisfactory.

Another drawback with the solutions presented is that in most cases it has been necessary to use bulky structures with downwardly extending parts which encroach upon the space for the legs and which may cause damages to the knees of the user.

The object of the invention has thus been to provide a table construction of the kind referred to which does not suffer the mentioned drawbacks and which may be produced at a low cost.

In order to accomplish these and other objects the invention has the characteristics which appear from the patent claims.

The accompanying drawings illustrate an exemplary embodiment of the invention in which FIG. 1 is a schematic side view of a table construction according to the invention and set for work in a sitting position.

The new table construction comprises a base frame generally designated as 1, which may be of any suitable kind and is here illustrated by means of a table stand which consists of a rectangular frame 2 supported by a number of legs 3. The parts of the table constructions may be connected to such a base frame but in the embodiment to be described in connection with FIGS. 3–5 inclusive the majority of said parts are assembled to a unit which in an easy manner may be connected to a base frame such as a table stand. The advantage with such units is of course that they may be fully produced at a factory and then rapidly and with a minimum of effort may be built in already manufactured furniture or furniture stands.

Figure 1:
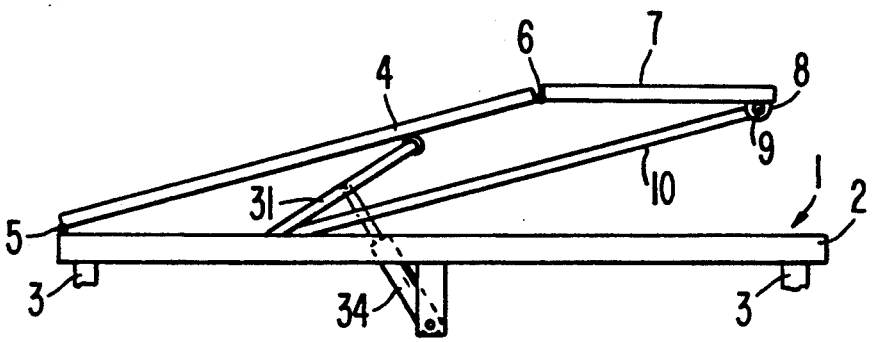
Figure 2:
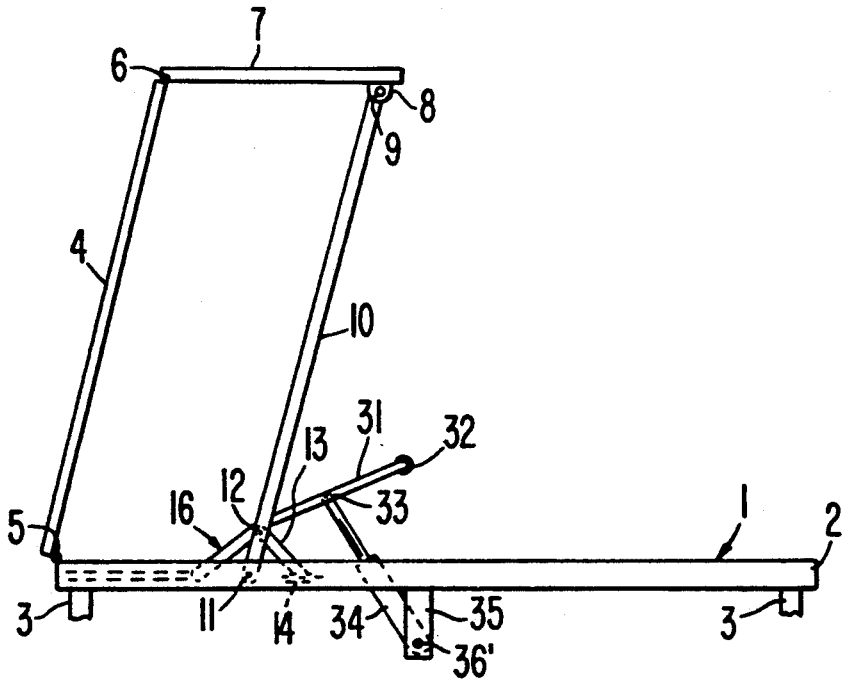
FIG. 2 is a similar illustration but with the table construction set for work in a standing position.

As appears from FIGS. 1 and 2 a first table top 4 is hingedly connected to the front edge of a table stand 1 by means of a hinge 5. Said first table top is in turn by means of a hinge 6 hingedly connected to a second table top 7. The latter has at the lower surface thereof bearings 8 for a pivot shaft 9, by means of which a link 10 is pivotally connected to the table top 7. The link 10 is at the opposite end thereof at 11 pivotally connected to the table stand and the pivot shafts are so chosen that the table tops 4 and 7 and the link and the part of the base frame which is located between the pivot points 5 and 11 together will form a parallel link system.

Pivotally connected to the link 10 at 12 is a catch arm 13 which in combination with a catch means 14 connected to the base frame can bring forth a locking of the link 10 and consequently the entire parallel link system in various angular positions.

Figure 5:
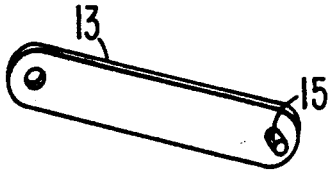

As appears from FIG. 5 the catch arm 13 near to one end thereof has projections 15 extending therefrom in opposite directions and which may consist of a dowel which penetrates the arm and is secured thereto for instance by a press fit and a support arm 16 (FIG. 3) is also pivotally mounted about the same axis as the catch arm 13.

Figure 3:
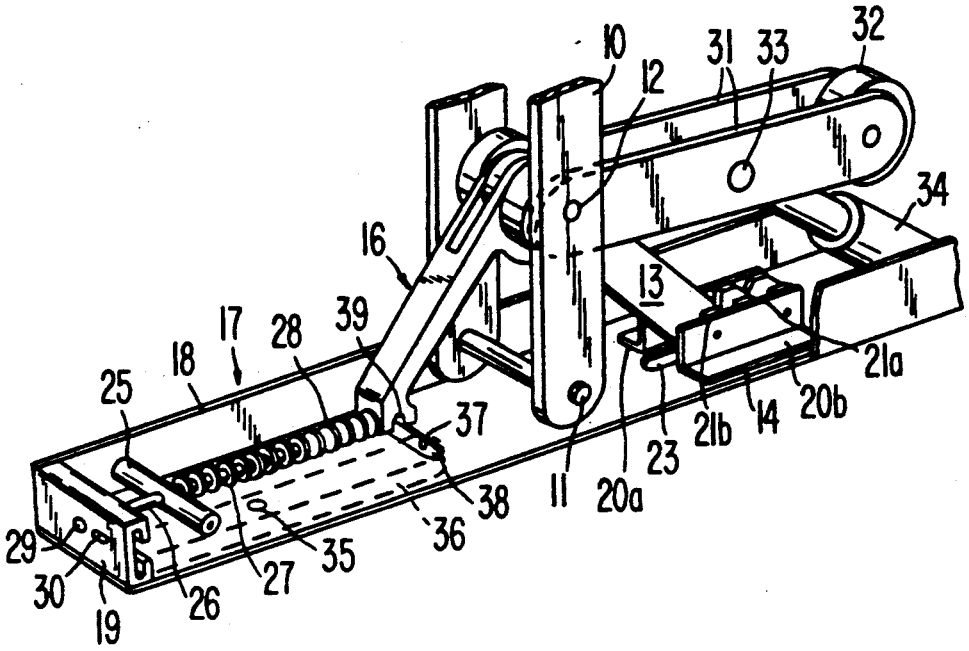
FIG. 3 shows in perspective and on an enlarged scale part of a unit forming part of the table construction while FIG. 4 also in perspective shows certain of the parts which form part of the unit according to FIG. 3 and FIG. 5, finally in perspective shows a part of FIG. 4.
Figure 4:
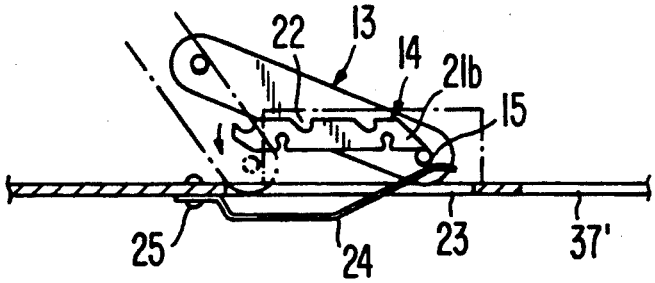

As initially mentioned most of the components of the device are assembled to a unit which is partly shown in FIG. 3 and there has the general designation 17.

This unit comprises a channel bar 18 which preferably bridges the distance between two opposite sides of the frame 2 and may be secured to said frame by simple means.

The pivot shaft 11 extends through the flanges of the channel bar. In order that the table tops 4 and 7 in the fully lowered position thereof may rest upon the upper edge portion of the flanges 18 of the channel bar the pivot shaft 11 is situated at a distance below said edge portion and for the same reason the pivot shaft 9 is situated a corresponding distance below the bottom surface of the table top 7.

One end of the channel bar has an end closure 19 and at a distance therefrom there are to the web portion of the channel bar 18 secured two mutually parallel angle irons 20*a*, 20*b* which have the vertical flanges thereof facing each other.

At each of said vertical flanges there is secured a plate 21*a* and 21*b* respectively, which has a number of recesses 22 extending from the upper surface thereof and for a purpose to be described.

In that portion of the channel bar which is located below the plates 21*a*, 21*b* the web portion thereof has an opening 23, through which there projects one end of a leaf spring 24, the opposite end of which being secured to the under side of the bar by means of a screw 25, a rivet or the like. As appears from FIG. 4 the leaf spring has an oblique end portion. Between the flanges of the U-beam 18 there is secured a rod 25, which has a transverse, central hole, through which extends a thinner portion 26 of a rod 27 which serves as a guide for a compression spring 28, having a length which is considerably bigger than the thicker portion of the rod 26. Thus the spring 28 will be guided in part of its extension and has one end thereof acting against the rod while the opposite end thereof comes into contact with the support arm 16 when the link 10 is swung upwardly as appears from FIG. 3.

Thus the spring may be compressed to an extent which corresponds to the difference in length between the spring and the thicker portion of the rod 27.

The thinner portion of rod 27 is received in a bore 29 in the end piece 19, which means that the rod 27 will be correctly set and guided parallel to the web portion of the channel bar 18. The end piece 19 may also have holes 30 for fastening screws or the like for connection to the table stand.

To the link 10, which as appears from FIG. 3 comprises two sideways spaced apart arms, there is pivotally mounted a lift arm 31 about the same shaft 12 as the support arm 16, said lift arm also comprising two sideways spaced arms and which at the free end thereof rotatably supports a roller 32.

At 33 there is hingedly connected to the lift arm the plunger of a gas cylinder assembly the cylinder of which being pivotally connected to a bracket 35 (see FIG. 2) extending downwardly from the channel bar in point 36. This cylinder extends through an opening 37 in the web portion of the bar 18.

As appears from FIG. 1 the lift arm 31 via the roller 32 acts against the under side of the table top 4 as long as the table top only forms a minor angle with the horizontal plane. In order to be able to employ a small and thus cheap gas cylinder assembly it is of importance that the range of action thereof is limited and this is achieved according to the invention in that the gas cylinder assembly only acts during part of the raising phase and more particularly to incline the table top 4 within the relatively small angle region suitable for desk use, for instance 0°-30°.

In order to reach the position of FIG. 2 for work in a standing position the arm system is manually pivoted upwardly.

When setting for work in a standing position it is important that the second table top 7 which then serves as a work surface will be as steady as possible. To this end the spring influence via the support arm 16 just described is of utmost importance since this spring action will effect a locking which is substantially free of play and which cannot inadvertently be brought out of function.

The spring action causes the projection of the catch arm to be pressed into the actual recesses 22 of the plates 21*a*, 21*b*.

When it is desired to set the table for desk function for work in a sitting position from the inactive position of the device where the table tops 4 and 7 rest against the frame 2 it is only necessary to release the gas cylinder assembly and to bear against until the gas-cylinder assembly via the lift arm has brought the table top 4 to the desired position. When this position has been reached the gas cylinder assembly is locked. If from this position it is desired to set the table in a position suitable for work in a standing position it is sufficient to lift up the table top 4 manually. At the end of this lifting movement this one has to be carried out against the resistance of the spring 28 acting upon the support arm 16. When swung upwardly the projections 15 slide against the upper surface of the catch plates 21*a*, 21*b* and successively fall into the recesses 22 thereof. When the desired angle has been attained it is only necessary to release the table top and the spring force will bring the projection into a secure engagement with the recess 22.

When it is desired to reset the table to the position of FIG. 1 it is only necessary to pull the table top 4 to such extent that the projection 15 of the catch arm passes the outermost recess 22 and behind (in the drawing to the left of) the catch plates 21*a*, 21*b*. Then the catch arm 13 will fall down into the position indicated by dotted lines in FIG. 4 where the projections 15 contact the wall portions of the web portion of the channel bar which limit the opening 23 sidewise. When the catch arm is displaced due to the folding down of the link and approach the position shown in full lines it will come into contact with the oblique part of the leaf spring 24 and during the continued forwards displacement thereof it will be influenced by the spring force exerted by the leaf spring. When thereafter the projections 15 pass over the right hand end of the catch plates 21*a*, 21*b* said spring force will swing the catch arm upwardly such that the projections 15 will be positioned above the lower edge portions of the catch plates 21*a*, 21*b*. During the continued folding down the catch arm 13 will slide against the web portion of the channel bar and during the entire folding the projections will thus effect no catching action.

When the link is then swung upwardly the projections 15 will be in such a height position that they owing to the oblique end portions of the catch plates will slide up to the upper surfaces thereof and locking can again be accomplished in the manner described.

In order to fold down completely the table top 4 from for instance the desk position which is attained when the table top again comes into contact with the roller 32 of the lift arm the gas cylinder assembly is again released which also causes the table top to be completely folded down. In some instances it is possible by proper dimensioning of the catch arm 13 relative to the link and by proper choice of pivot shaft and design of the catch plates to effect locking within the desk region as well as within the region for work in a standing position without employing a gas cylinder assembly but in many cases it is more convenient to arrange two or several pairs of catch plates consecutively and at such distances from each other that the projections 15 may pass between the front edges of rear pairs of plates and the rear edges of front pairs of plates and it is of course also possible to arrange the locking at the minor angles which are actual in the desk use in another way.

The catch plates 21*a*, 21*b* need not be secured to the angle bars 20*a*, 20*b* but may be pivotable in relation thereto and so designed that they while taking an oblique position with their front portion rest against the web portion of the channel bar 18 and are swung away by the projections when the catch arm is moved forwardly with the projections 15 acting against the under side of the catch plates. As appears from FIG. 3 the main part of the device comprises a unit, which is provided to be connected to a table stand in a suitable manner. In addition to the shown end piece 19 it is then possible to use end pieces having parts embracing the base frame or the like. The end piece 19 as well as the catch plates 21*a*, 21*b* and the support arm 16 may preferably be made by cutting metal profiles and also in other respects the invention may be varied within the scope of the claims.

In order to entirely eliminate the risk of an unwanted folding of the table tops primarily from the position for work in a standing position a catch arrangement according to FIG. 3 may be employed.

In such an arrangement there is to the under side of the channel bar 18 at 35 pivotally mounted an arm 36, which at one end thereof has an upwardly directed dowel 37, which extends through an arcuate opening 38 in the web portion of the channel bar 18. The portion of the dowel 37 which extends over the web portion can owing to the movement of arm 36 engage a correspondingly shaped, downwardly open recess 39 in the base portion of the support arm 16 and it is thus seen that the dowel with arm 36 in said position will make it impossible for the table tops to be folded from their uppermost position. The left end of the arm of course serves as a handle to bring the catch into active respectively inactive position.

A locking of the kind referred to may of course include more than one height position for instance when the base portion of the support arm is made wider and is provided with more recesses 39. The arm 36 further has a detent device, for instance a spring-influenced ball, which by snapping into recesses in the under side of the channel bar may be arrested in active respectively inactive positions.

I claim:

1. A table construction comprising:

a base frame (1);

a first table top (4) hingedly connected at one end thereof to the base frame and pivotable at a first pivot center (5) between various inclined positions at a plurality of angles relative to said base frame so as to enable a sitting person to perform work on said first table top;

a second table top (7);

said first table top further being hingedly connected at the opposite end thereof to the second table top, as part of a parallel arm system having a link (10) parallel to said first table top, such that said link is swingable from an initial substantially horizontal position to a substantially vertical position when said first table top is swung up substantially 90° from the base frame (1) while said second table top is in a substantially horizontal position irrespective of the angle of said first table top;

a catch arm (13) having a catch element (15);

a catch plate (21*a*, 21*b*) having an upper surface, said catch plate connected to said base frame at a distance from a second pivot center (11) of said link and remote from the first pivot center (5) of said first table top; said catch plate having in said upper surface at least one recess (22) in which said catch element is enterable;

said link (10) having the catch arm pivotably attached thereto with said catch element provided to cooperate with the upper surface of the catch plate connected to said base surface of the catch plate so as to prevent the link from swinging down at least from said substantially vertical position towards said initial position;

wherein when said link is at an angle slightly exceeding 90°, said catch element passes one end of the catch plate, falls down below the catch plate, and passes under said one recess and beyond the opposite end thereof, such that said catch element is brought up to cooperate with the upper surface of said catch plate when said link is swung down toward said initial position;

a manually releasable locking device (35–39) connected to the base frame and located between the first pivot center of said first table top and the second pivot center of said link;

said link (10) further having pivoted thereto a support arm (16); said support arm preventing the link from being swung up more than 90° by means of said locking device when said locking device is in a locking position, but in an unlocking position thereof permits such movement;

a spring element (28) acting upon said link when the latter approaches and passes an angle of substantially 90° from said initial horizontal position to urge said link into a position in which said locking device is lockable in said link;

and an extension on said first table top; said extension being perpendicular to the first pivot center thereof, such that when said first table top is in said vertical position, the second table top is located at a height suitable for work upon said second table top by a standing person.

2. A table construction as claimed in claim 1, wherein a resilient tongue (24) is secured under the catch plate; said tongue having an oblique part with an end portion in resilient contact with the under side of the catch plate in one end thereof to lift up the catch element (15) of the catch arm (13) after folding down the link and bringing it into cooperation with the upper surface of the catch plate.

3. A table construction as claimed in claim 1, wherein the catch element of the catch arm (13) consists of a pin (15) protruding from the arm and extending therefrom in both lateral directions, and the projecting pin portions each cooperate with the catch plate (21*a*, 21*b*) secured to vertical flanges of two mutually parallel walls; a lateral distance between the catch plates only to a minor extent exceeding the thickness of the arm such that said pin portions are cooperable with the said catch plates, and said walls extend from a suitably U-shaped bar (18) between the vertical flanges of which the link (10) is pivotably mounted.

4. A table construction as claimed in claim 1, wherein the spring element (28) acts upon the support arm (16).

5. A table construction as claimed in claim 14, wherein a lift arm (31) is pivotably connected to the base frame (1) and acts with the free end thereof;

said lift arm being in functional cooperation with an adjustable means (34) to bring the lift arm into various angular positions via a friction reducing means including a roller (32) acting against the underside of the first table top (4), the angular positions being considerably less than 90° with respect to the plane of the base frame to provide a desk with a lightly sloping table top and a horizontal table top in connection thereto;

the link having a third pivot center (12) at a distance from the second pivot center (11) of said link;

said catch arm being pivotally mounted about said third pivot center and being not cooperable with the catch means (14) at the base frame until the first table top (4) is swung up substantially 90° from the base frame.

6. A table construction as claimed in claim 1, wherein the catch plate is pivotally arranged.

7. A table construction as claimed in claim 1, wherein a lift arm (31) is hingedly connected to one end of a gas cylinder assembly (34); the opposite end of said one end of the gas cylinder assembly passes through an opening (37) in a channel bar (18); and the one end thereof is hingedly connected to a bracket (35) positioned under the channel bar;

wherein the catch arm (13) is hingedly connected to the link (10), such that the lift arm (31) is swingable up by means of the gas cylinder assembly at an angle considerably less than 90°, but the link (10) is manually swingable up substantially 90°.

8. A table construction as claimed in claim 1, wherein a first arm (36) is pivotally mounted at a lower side (35) of a channel bar; (18)

said first arm having at one end thereof an upwardly directed dowel (37) which passes through an arcuate opening (38) in a web portion of the channel bar (18);

and a portion of the dowel (37) projects over the web portion by a pivot movement of the first arm such that said portion is projectable into a downwardly open recess (39) in the base portion of the support arm (16) for locking the support arm (16) against pivotal movement.

9. A table construction as claimed in claim 8, wherein the support arm (16) in the base portion thereof has two or more mutually parallel recesses (39) situated at such a distance from each other that the support arm by means of the first arm (36) is lockable in positions corresponding to locking positions caused by the catch means (14).

* * * * *

UNITED STATES PATENT AND TRADEMARK OFFICE

CERTIFICATE OF CORRECTION

PATENT NO. : 5,199,360

DATED : April 6, 1993

INVENTOR(S) : Sirkka KOISTINEN

It is certified that error appears in the above-identified patent and that said Letters Patent is hereby corrected as shown below:

Claim 5, column 6, line 25, change "claim 14" to --claim 1--.

Signed and Sealed this

Twenty-fifth Day of January, 1994

*Attest:*

Bruce Lehman

BRUCE LEHMAN

*Attesting Officer*

*Commissioner of Patents and Trademarks*